US011725888B2

(12) United States Patent
Chase

(10) Patent No.: US 11,725,888 B2
(45) Date of Patent: Aug. 15, 2023

(54) MULTI-POSITION CONDENSATION KIT AND BRACKET

(71) Applicant: JOHNSON CONTROLS TECHNOLOGY COMPANY, Auburn Hills, MI (US)

(72) Inventor: Thomas D. Chase, Wichita, KS (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 237 days.

(21) Appl. No.: 16/706,215

(22) Filed: Dec. 6, 2019

(65) Prior Publication Data

US 2021/0102763 A1 Apr. 8, 2021

Related U.S. Application Data

(60) Provisional application No. 62/911,713, filed on Oct. 7, 2019.

(51) Int. Cl.

| | |
|---|---|
| ***F28F 17/00*** | (2006.01) |
| ***F24F 13/22*** | (2006.01) |
| ***F24H 8/00*** | (2022.01) |

(52) U.S. Cl.

CPC ..... *F28F 17/005* (2013.01); *F24F 13/222* (2013.01); *F28F 2280/00* (2013.01)

(58) Field of Classification Search

CPC ..... F28F 17/005; F28F 2280/00; F24F 13/22; F24F 13/222; F24F 2013/227; F24H 8/006; F25D 21/14; B60H 1/3233

USPC ..... 126/116 R

See application file for complete search history.

(56) References Cited

U.S. PATENT DOCUMENTS

| | | | | |
|---|---|---|---|---|
| 5,309,890 | A * | 5/1994 | Rieke | F24H 8/006 126/110 R |
| 5,320,087 | A * | 6/1994 | Froman | F23N 5/247 126/110 R |
| 5,379,749 | A * | 1/1995 | Rieke | F24H 8/006 126/110 R |
| 5,704,343 | A * | 1/1998 | Ahn | F24H 8/006 126/110 R |
| 6,196,015 | B1 * | 3/2001 | Pignolo | F24F 13/222 62/272 |
| 6,584,795 | B1 * | 7/2003 | Bruss | B60H 1/3233 62/285 |
| 9,038,622 | B2 | 5/2015 | Goundiah Ramasamy et al. | |
| 9,074,791 | B2 | 7/2015 | Rieke et al. | |
| 9,261,292 | B2 | 2/2016 | Sherrow | |
| 9,322,570 | B2 * | 4/2016 | Hodges | F24F 13/22 |
| 9,958,182 | B1 * | 5/2018 | Rimmer | F24F 13/222 |
| 10,605,480 | B1 * | 3/2020 | Des Champs | F16T 1/22 |
| 2005/0126558 | A1 * | 6/2005 | Riepenhoff | F24H 8/006 126/110 R |
| 2016/0313049 | A1 * | 10/2016 | Totaro | F25D 21/14 |
| 2017/0023274 | A1 * | 1/2017 | Peticca | F24F 13/222 |

* cited by examiner

*Primary Examiner* — Frantz F Jules
*Assistant Examiner* — Jason N Thompson
(74) *Attorney, Agent, or Firm* — Fletcher Yoder, PC

(57) ABSTRACT

A mounting bracket for mounting a condensate trap to a heating, venting, and air conditioning (HVAC) system that can be mounted in multiple orientations such that the condensate trap receives condensate fed by gravity.

20 Claims, 5 Drawing Sheets

MULTI-POSITION CONDENSATION KIT AND BRACKET

CROSS-REFERENCE TO RELATED APPLICATION

This application claims the benefit of U.S. Provisional Application Ser. No. 62/911,713, entitled "MULTI-POSITION CONDENSATION KIT AND BRACKET" and filed on Oct. 7, 2019, which is expressly incorporated by reference herein in its entirety.

FIELD OF THE INVENTION

The present disclosure relates generally to a condensation trap bracket and condensation trap kit usable with a heating, ventilating and air conditioning (HVAC) system. Specifically, for a condensation trap bracket and condensation trap kit that allows for multi-position mounting of the condensation trap with relation to an HVAC unit.

BACKGROUND

Heating and/or cooling systems, such as heating, ventilating and air conditioning (HVAC) systems often include a furnace and heat exchanger to heat the air circulated by the system. As air flows through the system, condensation can form. Water condensation can potentially build-up and cause the malfunction of, or damage to, components of the system, and therefore it is desirable to remove condensate or condensation from the system. Typically, a condensate trap is provided to facilitate the draining of condensation fluids from furnace components.

In some types of high efficiency HVAC systems (e.g., condensing furnaces), significant amounts of water may condense from the flue gas within the heat exchanger that must be collected in a condensate pan and drained separately from the flue gas exiting by the vent pipe. Conventional condensate traps are external to the condensate pan and fixed to the HVAC system. A condensate trap generally allows for fluid flow from an inlet to an outlet of the system despite pressure changes within the HVAC system. Further, a condensate trap may prevent or slow the intake of air or gas exterior to the system. Further, the condensate trap may prevent flue gas from escaping the furnace through the condensate drain line.

SUMMARY

In accordance with one aspect of the disclosure, a mounting bracket for mounting a condensate trap to a heating, venting, and air conditioning (HVAC) system that can be mounted in a vertical or horizontal orientation is disclosed. The bracket is configured to mount the condensate trap in multiple orientations such that the condensate trap receives condensate fed by gravity.

In accordance with one aspect of the disclosure, a kit for managing condensate of an HVAC system is disclosed. The kit includes a condensate trap having an inlet and an outlet in fluid communication with a cavity within the condensate trap, wherein the condensate trap is configured to retain a volume of condensate from the HVAC system. The kit further includes a mounting bracket having a mounting portion with a condensate trap mounting surface configured to have the condensate trap mounted thereto. The bracket further includes a unit mounting portion having a unit mounting surface that is substantially perpendicular to the condensate trap mounting surface. The kit further includes a conduit configured to create a fluid communication path between the condensate trap inlet and an outlet of the HVAC unit.

In accordance with one aspect of the disclosure, a kit for managing condensate of a heating, ventilating and air conditioning (HVAC) system is disclosed. The kit includes a condensate trap having an inlet and an outlet in fluid communication with a cavity within the condensate trap, wherein the condensate trap is configured to retain a volume of condensate from the HVAC system. The kit further includes a mounting bracket having a mounting portion with a condensate trap mounting surface configured to have the condensate trap mounted thereto and a unit mounting portion having a unit mounting surface that is substantially perpendicular to the condensate trap mounting surface. The kit also may include a straight fitting having an threaded portion configured to be threaded an outlet of the HVAC unit, wherein the straight fitting provides a communication path between the condensate trap inlet and the outlet of the HVAC unit. The kit may also include instructions to mount the condensate trap to a first surface of the HVAC system if the HVAC system is installed in a vertical orientation and instructions to mount the condensate trap to the mounting surface of the bracket and the unit mounting portion of the bracket to the first surface of the HVAC system if the HVAC system is installed in a horizontal orientation.

In accordance with another aspect of the disclosure, a bracket is disclosed. The bracket includes a mounting portion with a condensate trap mounting surface, wherein the mounting portion comprises a mounting hole for receiving a fastener to mount a condensate trap to the mounting surface. The bracket further includes a unit mounting portion having a unit mounting portion having a unit mounting surface that is substantially perpendicular to the condensate trap mounting surface. The unit mounting surface is configured to abut a first surface of the HVAC system when the unit mounting portion mounted to the HVAC system.

Additional advantages and features of these aspects will be set forth in part in the description that follows, and in part will become more apparent to those skilled in the art upon examination of the following or upon learning by practice of the disclosure.

BRIEF DESCRIPTION OF THE DRAWINGS

The features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

Figure 1:
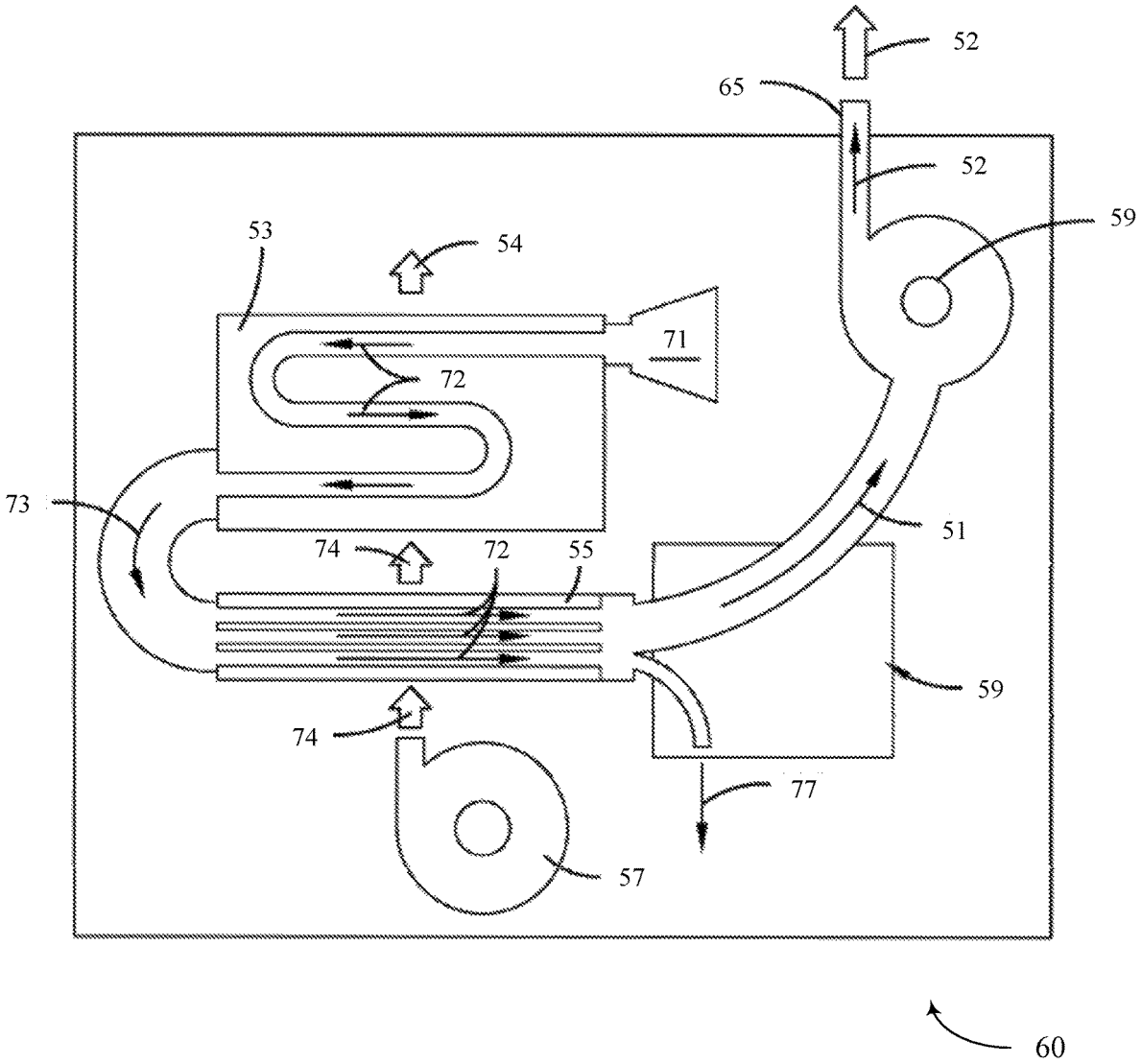
FIG. 1 is a schematic of a condensing furnace usable with aspects of the present disclosure.

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention.

Throughout the disclosure the term substantially may be used as a modifier for a geometric relationship between elements or for the shape of an element or component. While the term substantially is not limited to a specific variation and may cover any variation that is understood by one of ordinary skill in the art to be an acceptable variation, some examples are provided as follows. In one example, the term substantially may include a variation of less than 10% of the dimension of the object or component. In another example, the term substantially may include a variation of less than 5% of the object or component. If substantially is used to define the angular relationship of one element to another element, one non-limiting example of the term substantially may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference when the system and apparatus described herein is installed and in an in-use orientation.

In order to provide context to the current disclosure, a broad overview of the discovered deficiencies of various systems and an example implementation of the current disclosure and the advantages provided by the disclosure are described below. Further details of example implementations of the current disclosure are described detail with reference to the figures below.

Heating, ventilating and air conditioning (HVAC) systems often include a furnace and heat exchanger to heat the air circulated by the system. As air flows through the system, condensation can form. Further, in some HVAC systems, water may condense from the flue gas within the heat exchanger and may be collected in a condensate pan and drained separately from the flue gas. An example HVAC system may be referred to throughout the disclosure. It is noted that while one example may be discussed as an example, the current disclosure may relate to any type of system that provides heating or cooling in a commercial or residential context and requires the removal or drainage of condensation or condensate. Some examples may include one or more of a condensate furnace or high efficiency furnace, a furnace, a gas or electric furnace, a heat exchanger, or an air conditioner. Further, the system disclosed may be usable with any type of system that requires the drainage of condensation or condensate.

A condensate trap may be provided external to the condensate pan and fixed to an external surface of the HVAC system. One example of the disclosed condensate trap allows for fluid flow from the condensate pan to an outlet or drain separate from the system despite pressure changes within the HVAC system. For example, a condensate trap may prevent or slow the intake of air or gas external to the unit, or prevent the blockage of flow of condensate water from the condensate pan to the outlet or drain when the inside of the HVAC system is in vacuum or at a negative pressure with relation to an outside atmosphere. Further a condensate trap may prevent air or gasses from the inside of the HVAC system from escaping to an outside atmosphere. The condensate trap may also prevent blockage of a passage from the condensate pan to the outlet or drain. In a system where gravity provides the force necessary for water or condensate to drain from the condensate pan, the condensate trap may need to be positioned in a certain orientation in order for proper operation of the condensate trap. For example, in order for the condensate trap to properly function, the condensate trap may be required to be oriented vertically (e.g., with the condensate trap intake pointing upwards with respect to gravity and the drain pointing downward with respect to gravity) regardless of the orientation of the HVAC unit.

Some HVAC systems may for example be installed in various orientations or positions due to the design of the system. For example an HVAC system may be installed in an upflow position (with the heated and/or cooled air exiting vertical upwards), a downflow position (with the heated air and/or cooled air exiting vertically downwards), in a horizontal right or left position (with the heated and/or cooled air exiting in a corresponding horizontal direction). These variations may cause challenges when installing a condensate trap onto the HVAC unit.

In order to overcome the aforementioned deficiencies, in one example, the disclosure relates to a condensate management kit and condensate trap bracket that allows an HVAC system to be vertically or horizontally in any one of four configurations—upflow, downflow, horizontal right or horizontal left without the need for additional components or modifications to the HVAC system or condensate trap. The disclosed condensate management kit and/or bracket provide improved efficiency when installing a condensate trap, especially for a technician installing the HVAC system on site. The condensate management kit and bracket further provides for improved simplicity of installation and prevents incorrect installation of the condensate trap when an HVAC system is installed in any one of the aforementioned positions. Other features and advantages will be made apparent from the present specification. The teachings disclosed extend to those embodiments that fall within the scope of the claims, regardless of whether they accomplish one or more of the aforementioned needs.

FIG. 1 shows a broad overview of a schematic arrangement of an example HVAC system. One example HVAC system useable with the current disclosure may include a condensing furnace 60. During operation of the condensing furnace 60, a burner 71 combusts a fuel with combustion air 72 and provides hot combustion by-products and heated air to a first heat exchanger 53, where heat is transferred to supply air 74. Supply air 74 is air that is to be heated, such as interior air for a building HVAC system. The combustion air 72 is then directed into a second heat exchanger 55, where additional heat is exchanged with supply air 74. Supply air 74 is directed over first heat exchanger 53 and second heat exchanger 55 by use of a blower 57 or similar air-moving device.

As combustion air 72 exchanges heat with supply air 74, a portion of the water vapor in combustion air 72 condenses to a liquid. A resultant liquid condensate 77 emerges from second heat exchanger 55 and falls into a condensate pan 59 and is eventually directed out of the condensing furnace 60 and through the condensate trap described below. Likewise, the uncondensed portion of combustion air 72 emerges from second heat exchanger 55 as exhaust 51 and is removed from furnace 60 by use of an exhaust blower, or inducer, 59 or similar air-moving device through a vent, such as vent pipe 65. Exhaust 52 may include air, water vapor and other combustion products.

Liquid condensate 77 formed in second heat exchanger 55, in addition to water, may contain combustion products and other contaminants that can be acidic and/or corrosive. Thus, in one example, the second heat exchanger 55 and the areas in which the liquid condensate 77 forms and flows can be fabricated using corrosion resistant materials such as stainless steel or other heat resistant, corrosion resistant materials, such as plastic or fiberglass.

Figure 2:
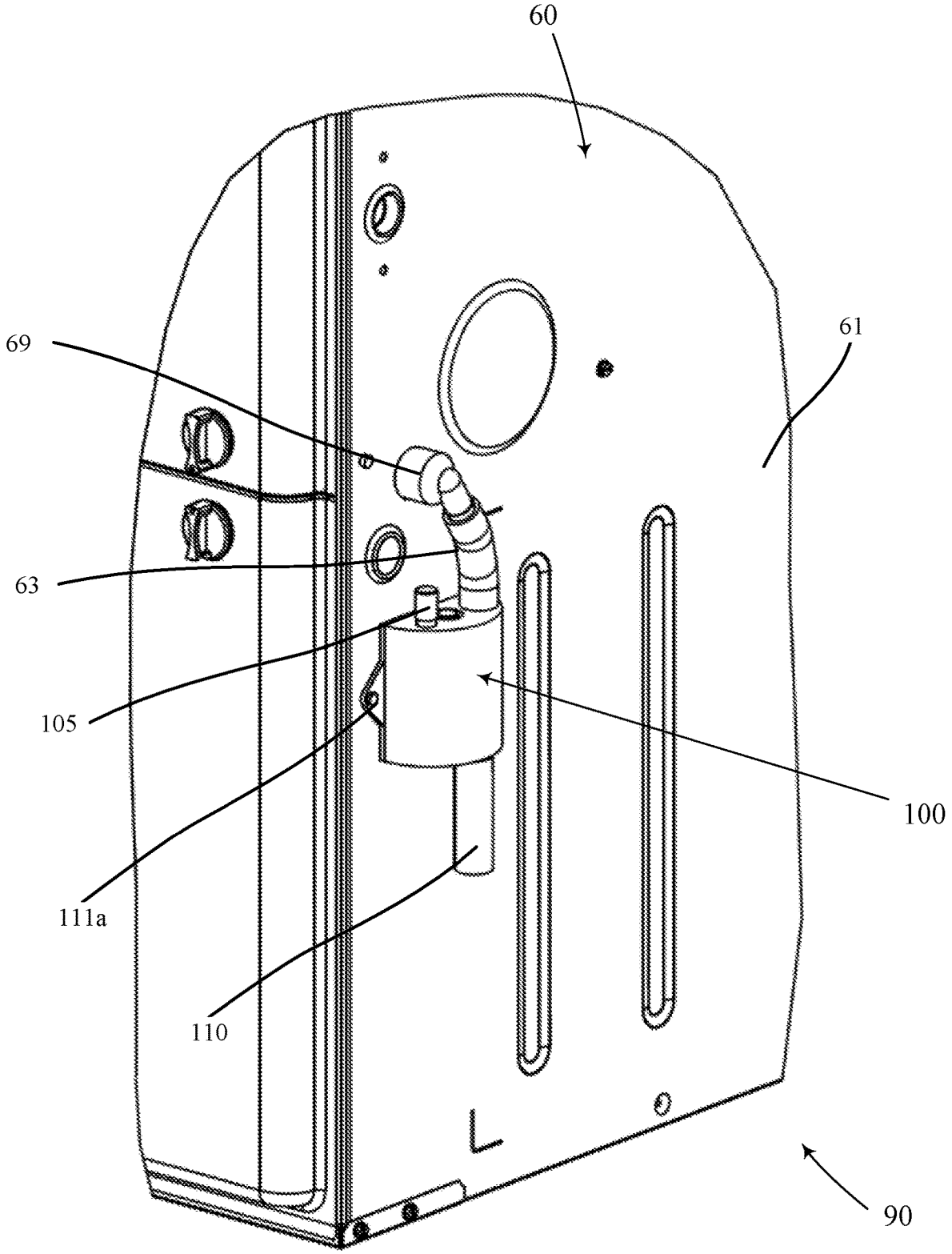
FIG. 2 is a partial perspective view of an example condensate management system in a first state of operation in accordance with one aspect of the present disclosure.

FIG. 2 shows one example of a condensate management kit 90. FIG. 2 represents one example of a condensate management kit installed onto an HVAC unit 60, when the HVAC unit is in the upflow position or vertical orientation. It is noted that while the condensate management kit 90 is shown as mounted on a left side of the unit with the unit in the upflow position, the management kit may likewise be mounted to an opposite side of the unit (e.g., a right side) and/or may be mounted to a right or left side of the unit if the unit is installed in a downflow position. Mounting of the condensate management kit 90 in the aforementioned positions would be similar and/or identical to the mounting shown in FIG. 2.

As shown in FIG. 2, when the HVAC unit is in an upflow position and/or a vertical orientation, a condensate trap 100 may be mounted on a side of the HVAC unit via fasteners 111*a* and 111*b* (hidden from view in FIG. 2). In one example, the fasteners 111*a* and 111*b* may be self-tapping fasteners. The condensate trap 100 may be mounted so that an intake of the condensate trap (e.g., 102 in FIG. 5) is pointed in an upwards direction, and the output or drain 109 (FIG. 5) is pointed in the downward direction. The intake 102 (FIG. 5) of the condensate trap 100, which may hereinafter be interchangeably referred to as an inlet, may be connected to an outlet or pan (e.g., 77 or 59 in FIG. 1), via a conduit including a tube 63 and a first fitting 69. The first fitting 69 may for example be an elbow fitting that is connected to a tube 63. It is noted that the first fitting 69 may also be interchangeably referred to as a bent fitting and/or as a first connector throughout the disclosure. The tube 63 may, for example, be connected to the first fitting 69 and to the intake 102 (FIG. 5) of the condensate trap 100 so as to provide a fluid communication therebetween. In one example, the first connector 69 may include threads that are configured to be threaded into receiving threads at the HVAC unit. In one example, the tube 63 may for example be flexible tubing or the like. As shown in FIG. 2, the output or drain 109 (FIG. 5) of the condensate trap 100 may be connected to a drain conduit 110. While not shown in FIGS. 2-3, the drain conduit 110 may for example be connected to a building drain system and/or may extend to a remote location from the HVAC unit. While not shown in FIGS. 2 and 3, the condensate management kit 90 may include a manual or instructions instructing a technician to install the condensate trap 100 in the position shown in FIG. 2, and using the components shown in FIG. 2, when the HVAC system 60 is installed in an upflow orientation and/or vertical orientation.

Figure 3:
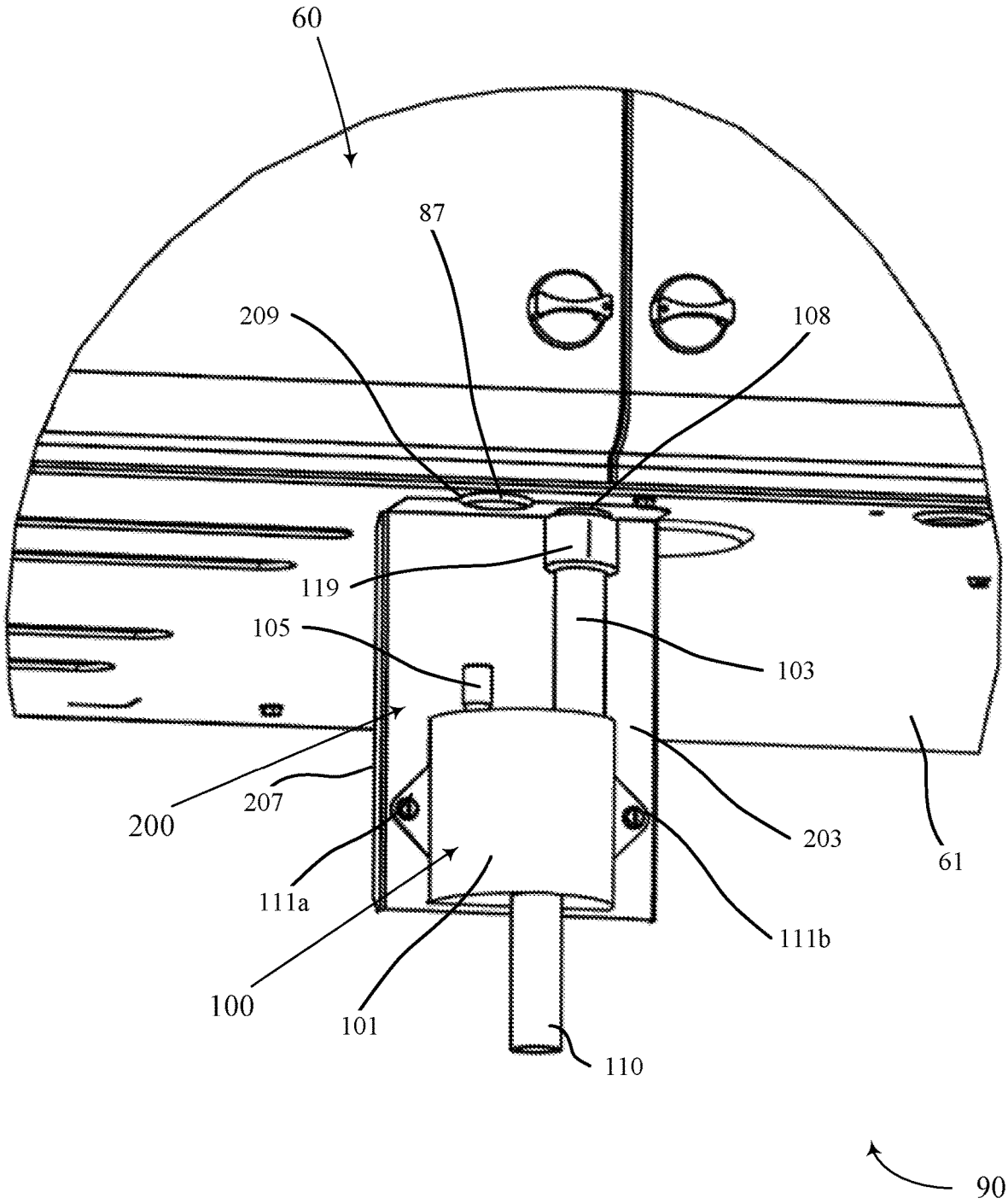
FIG. 3 is a partial perspective view of an example condensate management system in a second state of operation in accordance with an aspect of the present disclosure.

As shown in FIG. 3, when the HVAC unit 60 is in a horizontal orientation, a bracket 200 may be utilized to mount the condensate trap 100. The bracket 200 may be mounted to a first side 61 of the HVAC unit 60. The bracket may include a mounting portion 203 having a mounting surface configured to receive and have mounted thereto the condensate trap 100. The condensate trap 100 may be mounted so that a intake of the condensate trap (e.g., 102 in FIG. 5) is pointed in an upwards direction, and the output or drain 109 (FIG. 5) is pointed in the downward direction. The intake 102 (FIG. 5) of the condensate trap 100 may be connected to an outlet or pan (e.g., 77 or 59 in FIG. 1), via a conduit including a tube, which may be the same tube 63 as mentioned above or a second tube 103, and second fitting 119. It is noted that the second fitting 119 may hereinafter be interchangeably referred to as a straight fitting and/or as a second connector. The second fitting 119 may for example be connected to a second tube 103. The second tube 103 may for example be connected to the intake of the condensate trap 102 (FIG. 5) and the outlet 77 (FIG. 1) or pan 59 (FIG. 1) so as to provide a fluid communication therebetween. In one example, the second fitting 119 may include threads 108 that are configured to be threaded into receiving threads at the HVAC unit. In one example the second tube 103 may for example be flexible tubing or the like. As shown in FIG. 3, the output or drain 109 (FIG. 5) of the condensate trap 100 may be connected to a drain conduit 110. While not shown in FIGS. 2-3, the drain conduit 110 may for example be connected to a building drain system and/or may extend to a remote location from the HVAC unit. Thus, bracket 200 may allow the condensate trap 100 to be mounted in the same orientation as when the HVAC unit 60 is mounted in an upflow or vertical orientation (e.g., in a vertical orientation with the condensate trap intake pointing upwards with respect to gravity and the drain pointing downward with respect to gravity). While not shown in FIGS. 2 and 3, the condensate management kit 90 may include a manual or instructions instructing a technician to install the condensate trap 100 in the position shown in FIG. 3, using bracket 203 and other components described above with relation to FIG. 3, when the HVAC system 60 is installed in an horizontal orientation.

Figure 4:
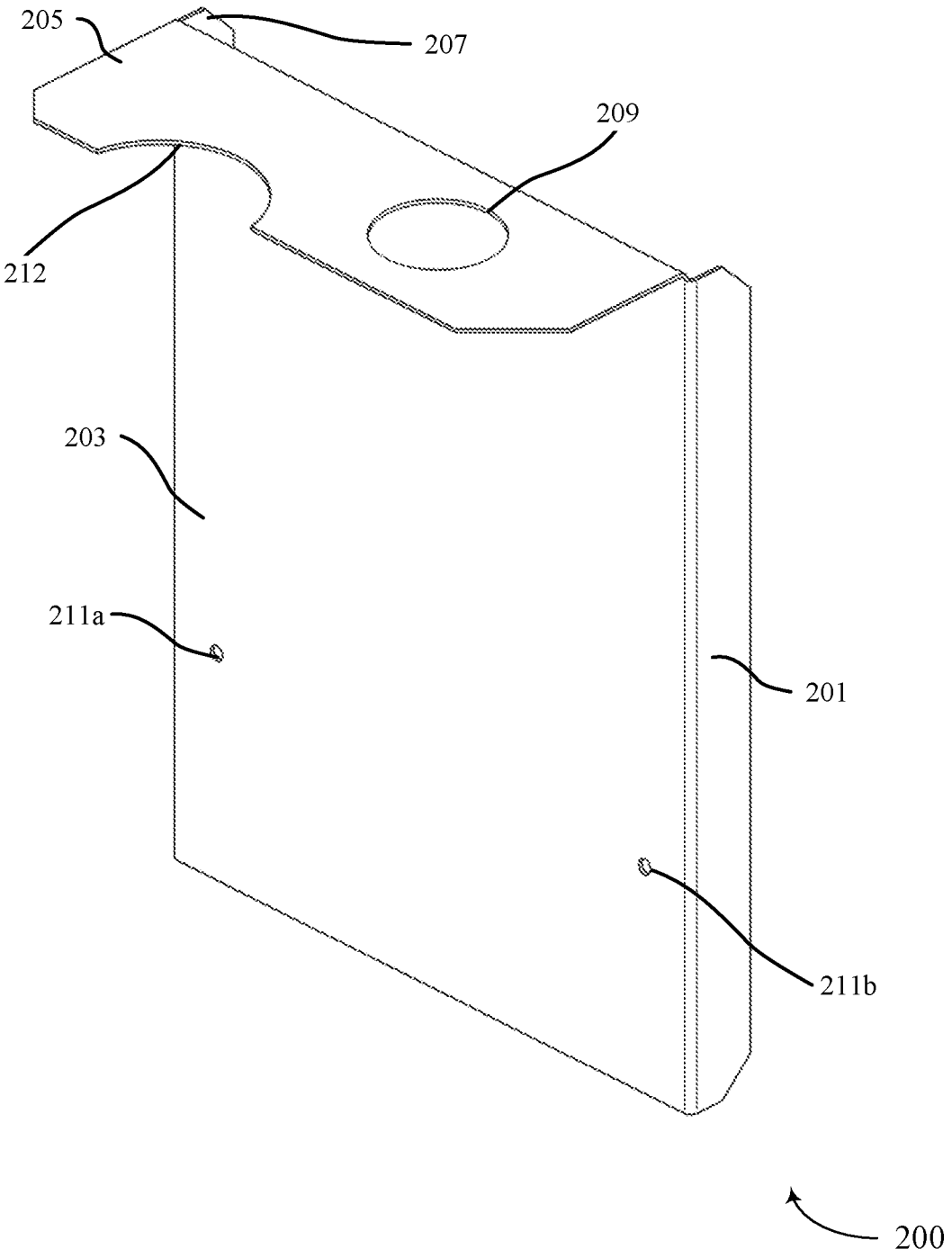
FIG. 4 is a side perspective view of the example bracket of FIGS. 2 and 3 in accordant with an aspect of the disclosure.

FIG. 4 shows a detailed view of one example of the bracket 200 shown in FIG. 3. The bracket 200 may include a substantially flat mounting portion 203 with a mounting surface. The mounting portion 203 may for example include two mounting features 211*a* and 211*b*, which may for example be through holes capable of receiving fasteners (e.g., 111*a* and 111*b* in FIGS. 2 and 3). In one example, the two mounting portions 211*a* and 211*b* may be mounting holes having a slightly smaller diameter than fasteners 111*a* (FIGS. 2 and 3) and 111*b* thus allowing for fasteners 111*a* and 111*b* to self-tap into the aforementioned mounting holes.

The bracket 200 may further include a unit mounting portion 205 that may for example form a flat surface that is substantially perpendicular or perpendicular to the flat mounting portion 203. The unit mounting portion 204 may for example include a first opening 209 and a cut-out 212. The first opening 209 may for example be dimensioned so that threads 108 (FIG. 3) of the second fitting 119 (FIG. 3) and/or the first fitting (69 (FIG. 2) may be received therethrough. In the aforementioned examples, the second fitting 119 and the first fitting 79 may have portions that are larger in diameter than first opening 209, so that the threads 108 of the second connector 119 or similar threads of the first connector 79 may be placed through the first opening 209 and threaded into the receiving threads at the HVAC unit until an upper surface of the unit mounting portion abuts a surface 61 of the HVAC unit 60, and the bracket 200 is secured to the HVAC unit as shown in FIG. 3. The HVAC unit may further include a plug 87 (FIG. 3) that is configured to partially fit within the cut-out 212 of the bracket 200. The bracket may further include a second portion 207 that forms a surface that is substantially perpendicular or perpendicular to the mounting portion 203 and the unit mounting portion 205. The bracket may also include a third portion 207 that forms a surface that is substantially parallel or parallel to the second portion 201 and is substantially perpendicular or perpendicular to the mounting portion 203 and the unit mounting portion 205.

Figure 5:
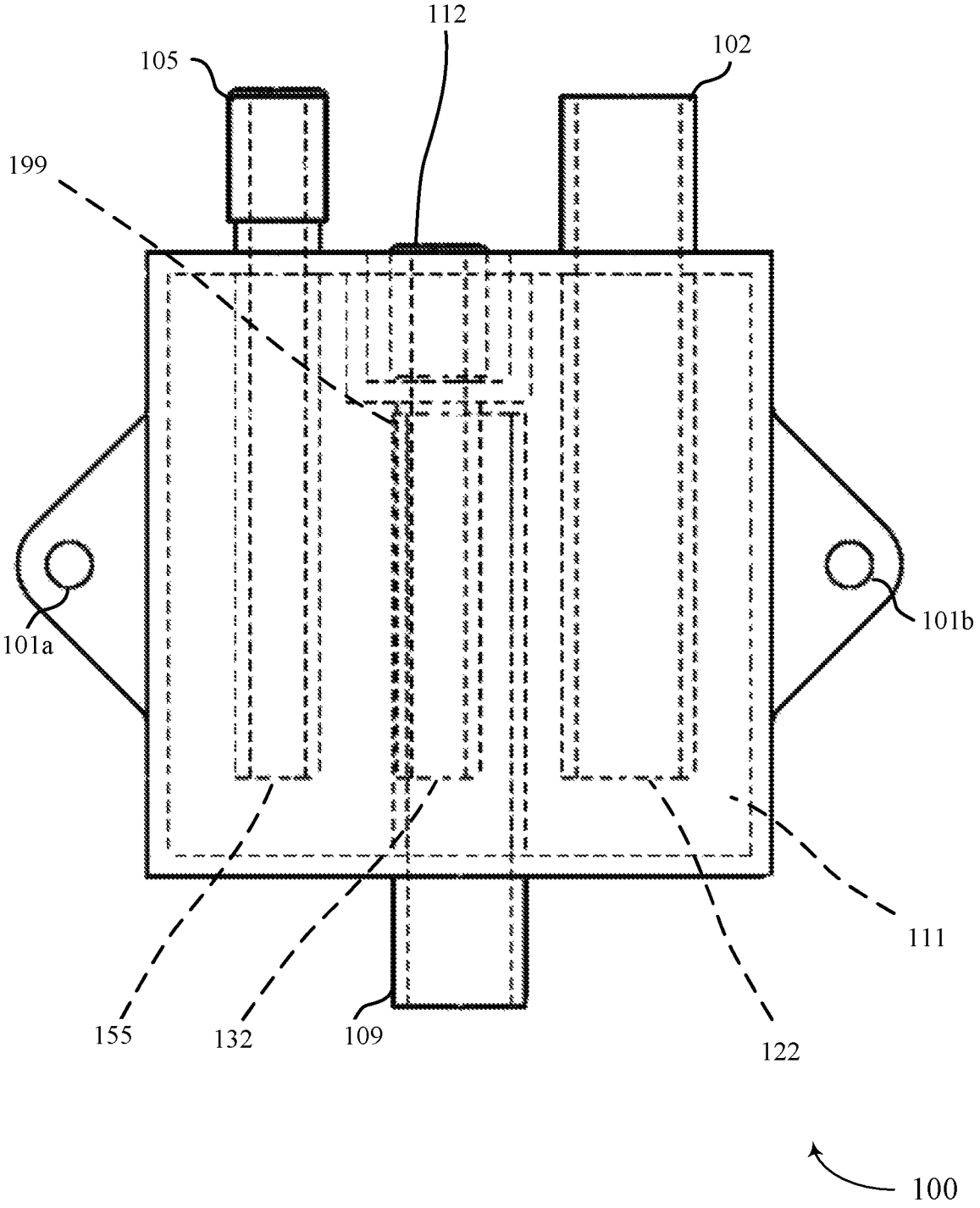
FIG. 5 is a side see-through view of the example condensate trap of FIGS. 2 and 3 in accordance with an aspect of the disclosure.

FIG. 5 shows one example of a condensate trap 100. The condensate trap 100 may have an inner cavity 111 that is capable of retaining water or condensate from HVAC unit 60. The condensate trap 100 may include a series of Inlets 102, 105, and 112. In the example shown above, inlets 105 and 112 are capped; however, either one of or both inlets 105 and 112 may also be un-capped and used as intakes either as an alternative to or in combination with inlet 102 as needed based on the location of the condensate trap 100 with relation to an outlet of the HVAC unit and/or based the number of outlets of the HVAC unit. Each of the inlets 102, 105, and 112 may include a respective conduit 122, 132, and 155 which extend downward into and are in fluid communication with the inner cavity 111. Further, the condensate trap may include an outlet 109 that may include a conduit 199 that extends upwards into the inner cavity 111. The extension of the inlets 102, 105, and 112 and the outlet 109 into the cavity may allow for the condensate trap to contain a volume of water or condensate in order to provide proper drainage from the outlet 109 while preventing or reducing back-flow of air or gas into the inlets 102, 105, and 112. For example, as shown in FIG. 5, the condensate trap 100 may fill with liquid condensate provided through inlet 102 until the level of condensate within cavity 111 reaches the top of conduit 199, at which point any additional condensate overflows over the top of conduit 199 and is drained via outlet 109.

The condensate trap 100 may further include mounting features 101*a* and 101*b* that may be through holes configured to receive fasteners (e.g., 111*a* and 111*b* in FIGS. 2 and 3). The holes may further be configured to align with and correspond to mounting features 211*a* and 211*b* (FIG. 4) of bracket 200 so that the condensate trap 100 may be mounted to the bracket 200 with fasteners 111*a* and 111*b* (FIGS. 2 and 3). In one example, the mounting features 101*a* and 101*b* may be through holes may have a diameter that is larger than the largest diameter of the threads on the aforementioned fasteners so that the fasteners may be passed through the mounting features 101*a* and 101*b* and fastened to mounting features 211*a* and 211*b* (FIG. 4) of bracket 200

The components and aspects mentioned throughout may be included as individual components of a kit that is provided for installation of an HVAC system. As noted above, the kit may further include instructions describing the installation of the components described above and providing instructions on how to install the components described above when the system is installed on an HVAC system to be installed in a vertical orientation and instructions on how to install the components described above when the system is installed on an HVAC system that is to be oriented in a horizontal orientation. For example, when the HVAC system is installed in the vertical orientation (e.g., as shown in FIG. 1), the bracket 200 may be omitted from the installation procedure and the condensate trap 100 may be mounted directly to the side 61 of the HVAC unit 60. Further, when the HVAC system is installed in the vertical orientation, the provided installation procedure may provide instructions that a first fitting 69 should be used. Further, when the HVAC system is installed in the horizontal orientation, the provided installation procedure may provide instructions that the condensate bracket 200 should be mounted to the HVAC system via the bracket 200. In addition, the second connector 119 may be used instead of the first fitting 69 when the HVAC system is installed in the horizontal orientation as shown in FIG. 3. The instructions provided may be a pamphlet or a printed manual provided with the components. As an alternative, the instructions may be provided digitally via a webpage, and may for example include videos outlining the installation procedures described and that may be implied by this disclosure.

The foregoing description of various aspects and examples have been presented for purposes of illustration and description. It is not intended to be exhaustive nor to limit the disclosure to the forms described. The embodiment (s) illustrated in the figures can, in some instances, be understood to be shown to scale for illustrative purposes. Numerous modifications are possible in light of the above teachings, including a combination of the abovementioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

What is claimed is:

1. A mounting bracket configured to mount a condensate trap to a heating, ventilating, and air conditioning (HVAC) system, wherein the condensate trap is configured to mount to the HVAC system in multiple orientations relative to the HVAC system and to receive a flow of condensate into an inner cavity of the condensate trap induced by gravity in each orientation of the multiple orientations, wherein the inner cavity is configured to retain condensate from the HVAC system independently of the mounting bracket, and wherein the mounting bracket comprises:

a mounting portion comprising a first flat surface; and a unit mounting portion comprising a second flat surface extending cross-wise to the first flat surface, wherein the unit mounting portion comprises a through hole, the mounting bracket is configured to be mounted to a surface of the HVAC system via a fitting extending through the through hole and coupled to a condensate outlet of the HVAC system, and the fitting is configured to direct the flow of condensate from the condensate outlet of the HVAC system to the inner cavity of the condensate trap.

2. The mounting bracket of claim 1, wherein the first flat surface is a condensate trap mounting surface, wherein the mounting portion comprises a mounting receiving portion configured to receive a fastener to mount the condensate trap to the condensate trap mounting surface and wherein the second flat surface is a unit mounting surface that is substantially perpendicular to the condensate trap mounting surface, wherein the unit mounting surface is configured to abut the surface of the HVAC system when the unit mounting portion is mounted to the HVAC system.

3. The mounting bracket of claim 2, wherein the unit mounting surface defines the through hole, wherein the through hole of the unit mounting portion is configured to receive a threaded portion of the fitting, wherein the mounting bracket is configured to mount to the HVAC system via the threaded portion of the fitting extending through the through hole and threading into receiving threads at the condensate outlet of the HVAC system.

4. A kit for managing condensate of a heating, ventilating, and air conditioning (HVAC) system, comprising:

a condensate trap having an inlet port formed in a surface of the condensate trap and an outlet port formed in an additional surface of the condensate trap, wherein the inlet port and the outlet port are in fluid communication with a cavity within the condensate trap, wherein the condensate trap is configured to retain a volume of the condensate received from the HVAC system;

a mounting bracket comprising:

a mounting portion with a condensate trap mounting surface configured to have the condensate trap mounted thereto, wherein the condensate trap mounting surface is a first flat surface; and a unit mounting portion having a unit mounting surface that is substantially perpendicular to the condensate trap mounting surface, wherein the unit mounting surface is a second flat surface, and wherein the cavity of the condensate trap is defined by the condensate trap independent of the mounting bracket; and a conduit configured to create a fluid communication path between the inlet port of the condensate trap and an outlet of the HVAC system, wherein the condensate trap is configured to be installed in a vertical orientation with the outlet port of the condensate trap facing a downward direction with respect to gravity and the inlet port of the condensate trap facing an upward direction with respect to gravity in a first configuration of the kit with the HVAC system and in a second configuration of the kit with the HVAC system, wherein the HVAC system is oriented vertically in the first configuration of the kit, and the HVAC system is oriented horizontally in the second configuration of the kit.

5. The kit of claim 4, wherein the conduit comprises:

a straight fitting having a threaded portion configured to be threaded into the outlet of the HVAC system; and a tube configured to be affixed to the straight fitting at a first end of the tube and to the inlet port of the condensate trap at a second end of the tube in the second configuration of the kit.

6. The kit of claim 5, further comprising:

a bent fitting having an additional threaded portion configured to be threaded into the outlet of the HVAC system and forming a bent passage, wherein the tube is configured to be affixed to the bent fitting at the first end and to the inlet port of the condensate trap at the second end in the first configuration of the kit.

7. The kit of claim 6, wherein the bent fitting is configured to be threaded into the outlet of the HVAC system in the first configuration of the kit.

8. The kit of claim 5, wherein the unit mounting portion of the mounting bracket includes a through hole, wherein the mounting bracket is configured to be mounted to a first surface of the HVAC system by passing the threaded portion of the straight fitting through the through hole and threading the straight fitting into the outlet of the HVAC system.

9. The kit of claim 4, further comprising:

first instructions to mount the condensate trap directly to a first surface of the HVAC system in the first configuration of the kit; and second instructions to mount the condensate trap to the first surface of the HVAC system via the mounting bracket in the second configuration of the kit.

10. The kit of claim 9, wherein the second instructions further comprise instructions to mount the unit mounting portion of the mounting bracket to the first surface of the HVAC system and to mount the condensate trap to the condensate trap mounting surface of the mounting bracket in the second configuration of the kit with the HVAC system.

11. The kit of claim 9, wherein the first instructions further comprise instructions to connect the outlet of the HVAC system to the inlet port of the condensate trap via a bent fitting in the first configuration of the kit; and wherein the second instructions further comprise instructions to connect the outlet of the HVAC system to the inlet port of the condensate trap via a straight fitting in the second configuration of the kit.

12. The kit of claim 4, further comprising:

a fastener configured to pass through a first hole of the condensate trap and into a second hole of the condensate trap mounting surface of the mounting portion of the mounting bracket to affix the condensate trap to the mounting bracket in the second configuration of the kit.

13. The kit of claim 12, wherein the fastener is further configured to pass through the first hole of the condensate trap, through the second hole in the condensate trap mounting surface of the mounting portion of the mounting bracket, and into a third hole in a first surface of the HVAC system to affix the condensate trap to the HVAC system in the second configuration of the kit.

14. A kit for managing condensate of a heating, ventilating, and air conditioning (HVAC) system, comprising:

a condensate trap having an inlet port formed in a surface of the condensate trap and an outlet port formed in an additional surface of the condensate trap, wherein the inlet port and the outlet port are in fluid communication with a cavity within the condensate trap, wherein the condensate trap is configured to retain a volume of the condensate received from the HVAC system, wherein the inlet port faces an upward direction with respect to gravity and the outlet port faces a downward direction with respect to gravity in each mounted orientation of a plurality of mounted orientations of the condensate trap with the HVAC system;

a mounting bracket having a mounting portion with a condensate trap mounting surface configured to have the condensate trap mounted thereto, and a unit mounting portion having a unit mounting surface that is substantially perpendicular to the condensate trap mounting surface, wherein the condensate trap mounting surface is a flat surface, wherein the cavity is defined by the condensate trap independently of the mounting bracket; and a fitting having a threaded portion configured to be threaded into an outlet of the HVAC system, wherein the fitting is configured to provide a communication path between the inlet port of the condensate trap and the outlet of the HVAC system.

15. The kit of claim 14, further comprising:

an instruction sheet comprising first instructions to mount the condensate trap directly to a first surface of the HVAC system in a first configuration of the kit with the HVAC system, wherein the HVAC system is in a vertical orientation in the first configuration of the kit, and second instructions to mount the condensate trap to the condensate trap mounting surface of the mounting bracket and to mount the unit mounting portion of the mounting bracket to the first surface of the HVAC system in a second configuration of the kit with the HVAC system, wherein the HVAC system is in a horizontal orientation in the second configuration of the kit.

16. The kit of claim 14, wherein the fitting is a straight fitting, wherein the unit mounting portion of the mounting bracket includes a through hole, wherein the mounting bracket is configured to be mounted to a first surface of the HVAC system by passing the threaded portion of the straight fitting through the through hole and threading the straight fitting into the outlet of the HVAC system with the HVAC system in a horizontal orientation.

17. The kit of claim 14, wherein the fitting is a bent fitting having a threaded portion configured to be threaded into the outlet of the HVAC system and forming a bent passage, and wherein the condensate trap is configured to be mounted directly to a first surface of the HVAC system by threading the bent fitting into the outlet of the HVAC system with the HVAC system in a vertical orientation.

18. The kit of claim 14, further comprising:

a tube configured to connect to the fitting at a first end of the tube and to the inlet port of the condensate trap at a second end of the tube to provide fluid communication between the outlet of the HVAC system and the inlet port of the condensate trap.

19. A mounting bracket configured to mount a condensate trap to a heating, ventilating, and air conditioning (HVAC) system, comprising:

a mounting portion comprising a first flat surface defining a condensate trap mounting surface, wherein the mounting portion comprises a mounting receiving portion for receiving a fastener therethrough to mount the condensate trap to the condensate trap mounting surface; and a unit mounting portion comprising a second flat surface defining a unit mounting surface that is substantially perpendicular to the condensate trap mounting surface, wherein the unit mounting surface is configured to abut a surface of the HVAC system and extend substantially parallel with the surface of the HVAC system to mount the unit mounting portion to the HVAC system, wherein the condensate trap is configured to mount to the HVAC system in a vertical orientation of the HVAC system and in a horizontal orientation of the HVAC system, and wherein the condensate trap is configured to receive a flow of condensate induced by gravity in the vertical orientation of the HVAC system and the horizontal orientation of the HVAC system wherein the unit mounting surface defines a through hole, wherein the through hole is configured to receive a threaded portion of a fitting, wherein the mounting bracket is configured to mount to the HVAC system via the threaded portion of the fitting extending through the through hole and threading the threaded portion of the fitting into receiving threads of a condensate outlet of the HVAC system.

20. The mounting bracket of claim 19, wherein the unit mounting portion comprises a cut-out formed in an edge of the unit mounting portion.

* * * * *